US009103341B2

(12) United States Patent
Le Coat et al.

(10) Patent No.: US 9,103,341 B2
(45) **Date of Patent: *Aug. 11, 2015**

(54) SCROLL REFRIGERATION COMPRESSOR WITH IMPROVED RETAINING MEANS AND BYPASS VALVES

(75) Inventors: Jean-Francois Le Coat, Villefranche sur Saone (FR); Mickael Bron, Saint Bonnet de Mure (FR); Pierre Ginies, Sathonay Village (FR); Dominique Gross, Jassans Riottier (FR); Franck Meynand, Saint Didier de Formans (FR)

(73) Assignee: DANFOSS COMMERCIAL COMPRESSORS, Trevoux (FR)

( * ) Notice: Subject to any disclaimer, the term of this patent is extended or adjusted under 35 U.S.C. 154(b) by 57 days.

This patent is subject to a terminal disclaimer.

(21) Appl. No.: 13/994,952

(22) PCT Filed: Nov. 29, 2011

(86) PCT No.: PCT/FR2011/052803

§ 371 (c)(1),
(2), (4) Date: Aug. 1, 2013

(87) PCT Pub. No.: WO2012/080613

PCT Pub. Date: Jun. 21, 2012

(65) Prior Publication Data

US 2013/0315768 A1 Nov. 28, 2013

(30) Foreign Application Priority Data

Dec. 16, 2010 (FR) ..... 10 60594

(51) Int. Cl.
*F03C 2/00* (2006.01)
*F03C 4/00* (2006.01)
(Continued)

(52) U.S. Cl.
CPC ..... *F04C 18/00* (2013.01); *F04C 18/0215* (2013.01); *F04C 18/0253* (2013.01);
(Continued)

(58) Field of Classification Search
USPC ..... 418/55.1–55.6, 57, 180, 270, DIG. 1; 417/310, 307, 308, 410.5, 440
See application file for complete search history.

(56) References Cited

U.S. PATENT DOCUMENTS 4,696,630 A 9/1987 Sakata et al.
5,090,880 A 2/1992 Mashimo
(Continued)

FOREIGN PATENT DOCUMENTS

CA 2544112 A1 11/2006
CN 1158944 A 9/1997
(Continued)

OTHER PUBLICATIONS

Preliminary Search Report issued in French Patent Application No. 1060594 dated Jul. 20, 2011.
(Continued)

*Primary Examiner* — Theresa Trieu
(74) *Attorney, Agent, or Firm* — Oliff PLC

(57) ABSTRACT

The scroll compressor includes stationary and moving volutes each including a scroll plate provided with a spiral wrap, the spiral wraps defining the variable-volume compression chambers, a delivery conduit including a first end emerging in a central compression chamber and a second end designed to be communicated with a delivery chamber, a delivery valve movable between closing and opening positions for closing and opening at least one delivery opening arranged to communicate the delivery conduit and the delivery chamber, at least one bypass valve associated with a bypass passage arranged to communicate the delivery chamber with an intermediate compression chamber. The compressor includes a retaining plate mounted on the scroll plate of the stationary scroll and on which first and second retaining elements are formed, the latter being arranged to limit respectively the amplitude of movement of the delivery valve and of each bypass valve toward the opening position thereof.

12 Claims, 4 Drawing Sheets

(51) Int. Cl.

| | |
|---|---|
| ***F04C 2/00*** | (2006.01) |
| ***F04C 18/00*** | (2006.01) |
| ***F04C 18/02*** | (2006.01) |
| ***F04C 29/04*** | (2006.01) |
| ***F04C 28/26*** | (2006.01) |
| ***F04C 29/12*** | (2006.01) |
| *F04C 23/00* | (2006.01) |

(52) U.S. Cl.
CPC ..... *F04C18/0261* (2013.01); *F04C 28/26* (2013.01); *F04C 29/04* (2013.01); *F04C 29/128* (2013.01); *F04C 23/008* (2013.01)

(56) References Cited

U.S. PATENT DOCUMENTS

| | | | |
|---|---|---|---|
| 5,169,294 | A | 12/1992 | Barito |
| 5,567,137 | A | 10/1996 | Nakashima et al. |
| 5,674,058 | A | 10/1997 | Matsuda et al. |
| 5,855,475 | A | 1/1999 | Fujio et al. |
| 6,227,830 | B1 | 5/2001 | Fields et al. |
| 6,494,688 | B1 | 12/2002 | Barito et al. |
| 8,585,381 | B2 | 11/2013 | Kiyokawa et al. |
| 2004/0057848 | A1 | 3/2004 | Haller et al. |
| 2007/0217938 | A1 | 9/2007 | Cho |
| 2009/0041603 | A1 | 2/2009 | Ginies et al. |
| 2009/0185926 | A1 | 7/2009 | Bush |
| 2010/0215535 | A1 * | 8/2010 | Kiyokawa et al. ..... 418/55.1 |

FOREIGN PATENT DOCUMENTS

| | | | | | |
|---|---|---|---|---|---|
| CN | 1854525 | A | | 11/2006 | |
| CN | 101813088 | A | | 8/2010 | |
| JP | 63117187 | A | * | 5/1988 | ..... F04C 18/02 |
| JP | 08247053 | A | * | 9/1996 | ..... F04C 18/02 |
| JP | A-10-77977 | | | 3/1998 | |
| JP | 11324950 | A | * | 11/1999 | ..... F04C 18/02 |
| JP | 2002/364565 | A | | 12/2002 | |
| JP | 2003/254267 | A | | 9/2003 | |

OTHER PUBLICATIONS

Mar. 5, 2013 International Search Report issued in International Patent Application PCT/FR2011/052785.
Jul. 8, 2011 French Preliminary Search Report issued in Application No. 1060590.
Mar. 5, 2013 International Search Report issued in International Patent Application No. PCT/FR2011/052777.
Oct. 24, 2014 Office Action issued in U.S. Appl. No. 13/994,875.

* cited by examiner

SCROLL REFRIGERATION COMPRESSOR WITH IMPROVED RETAINING MEANS AND BYPASS VALVES

BACKGROUND OF THE INVENTION

The present invention relates to a scroll refrigeration compressor.

In a known manner, a scroll refrigeration compressor comprises a sealed casing containing a stationary scroll and moving scroll following an orbital movement, each scroll including a scroll plate from which a spiral wrap extends, the spiral wraps of the stationary and moving scrolls being engaged in one another and defining variable-volume compression chambers, the compression chambers having a volume that decreases gradually from the outside, where the refrigerant gas is admitted, toward the inside.

Thus, during the relative orbital movement of the first and second scrolls, the refrigerant gas is compressed due to the decrease in the volume of the compression chambers and conveyed to the center of the first and second scrolls. The compressed refrigerant gas leaves from the central part toward a delivery chamber through a delivery conduit formed in the stationary scroll.

In order to improve the performance of such a compressor depending on the season, and more particularly depending on the demand for cold, this compressor may have a variable capacity and/or a variable compression rate.

Document U.S. Pat. No. 5,855,475 describes a scroll refrigeration compressor with a variable compression rate comprising on the one hand refrigerant fluid passage orifices formed in the scroll plate of the stationary scroll and each respectively emerging in one of the compression chambers and in the delivery chamber, and on the other hand bypass valves disposed on the surface of the scroll plate of the stationary scroll turned toward the side opposite the spiral wraps and each movable between an open position, allowing refrigerant fluid to be delivered from the corresponding compression chamber to the delivery chamber, and a closed position, preventing refrigerant fluid from being delivered from the corresponding compression chamber to the delivery chamber.

When one of the bypass valves is subjected, on the face thereof turned toward the scroll plate of the stationary scroll, to a pressure lower than the pressure in the delivery chamber, said bypass valve is kept in its closed position and isolates the corresponding compression chamber from the delivery chamber. As a result, the compression rate of the compressor is kept at its maximum value.

When one of the bypass valves is subjected, on the face thereof turned toward the scroll plate of the stationary scroll, to a pressure higher than the pressure in the delivery chamber, said bypass valve deforms elastically toward the open position thereof and communicates the corresponding compression chamber with the delivery chamber. This therefore results in a delivery to the delivery chamber of part of the refrigerant fluid compressed in the compression chambers in which the passage orifices emerge before that part of the refrigerant fluid reaches the center of the spiral wraps.

The presence of such passage orifices and such bypass valves makes it possible to decrease the compression rate of each compression chamber as a function of the operating conditions, and to thereby avoid over-compressing the refrigerant fluid. These arrangements must make it possible to improve the energy output of the compressor.

In order to decrease the mechanical forces exerted on the stationary scroll, and therefore on the moving scroll and the drive shaft driving the moving scroll, it is known to mount a separating plate on the face of the scroll plate of the stationary scroll turned toward the delivery chamber such that said delivery chamber is at least partially defined by the sealed casing of the compressor and the separating plate. The presence of such a separating plate thereby makes it possible to increase the reliability of the compressor.

Furthermore, in order to still further improve the reliability of the compressor, it is known to mount the separating plate movably with respect to the stationary scroll in a direction substantially parallel to the longitudinal axis of the compressor.

Installing bypass valves, as described in document U.S. Pat. No. 5,855,475, on the upper surface of a stationary scroll of the compressor equipped with a separating plate is difficult, or even impossible, due to the fact that access to the upper surface of the stationary scroll is hindered by the presence of the separating plate.

SUMMARY OF THE INVENTION

The present invention aims to resolve these drawbacks.

The technical problem at the base of the invention therefore consists of providing a scroll refrigeration compressor that has a simple and cost-effective structure, and that makes it possible to improve the performance of the compressor, while allowing a simple and easy assembly of at least one bypass valve.

To that end, the present invention relates to a scroll refrigeration compressor comprising:

- a sealed casing containing a stationary scroll and a moving scroll following an orbital movement, each scroll including a scroll plate from which a spiral wrap extends, the spiral wraps of the stationary and moving scrolls being engaged in one another and defining variable-volume compression chambers,
- a delivery conduit, formed in the central portion of the scroll plate of the stationary scroll, comprising a first end emerging in a central compression chamber and a second end designed to be communicated with a delivery chamber at least partially defined by the sealed casing,
- a valve arrangement mounted on the scroll plate of stationary scroll at the second end of the delivery conduit, the valve arrangement comprising:
  - at least one delivery opening arranged to communicate the delivery conduit and the delivery chamber,
  - a delivery valve movable between closing and opening positions for closing and opening the at least one delivery opening, the delivery valve being designed to be moved into the opening position thereof when the pressure in the delivery conduit exceeds the pressure in the delivery chamber by a predetermined value,
  - first retaining means arranged to limit the amplitude of movement of the delivery valve toward the opening position thereof,
- at least one bypass passage arranged to communicate the delivery chamber with an intermediate compression chamber,
- at least one bypass valve associated with a bypass passage, each bypass valve associated with a bypass passage being movable between closing and opening positions for closing and opening the corresponding bypass passage, and being designed to be moved into the opening position thereof when the pressure in the intermediate compression chamber in which the corresponding bypass passage emerges exceeds the pressure in the delivery chamber by predetermined value, second abutment means arranged to limit the amplitude of movement of each bypass valve toward the opening position thereof, wherein the compressor includes a retaining plate mounted on the scroll plate of the stationary scroll and on which the first and second retaining means are formed, and the second retaining means include at least one recess formed on the surface of the retaining plate turned toward the scroll plate of the stationary scroll, each recess being at least partially defined by a bottom wall forming an abutment surface arranged to limit the amplitude of movement of the associated bypass valve toward the opening position thereof.

The fact that the first and second retaining means are formed on a same retaining plate allows a simple and quick assembly of each bypass valve, despite the optional presence of the separating plate, given that it is not necessary to perform successive assemblies of different retaining means.

In fact, the positioning of the different bypass valves and associated retaining means may be done either by assembling each bypass valve on the scroll plate of the stationary scroll, then assembling the retaining plate on the scroll plate of the stationary scroll, or by assembling each bypass valve on the separating plate before assembling the latter on the scroll plate of the stationary scroll, then assembling the retaining plate on the scroll plate of the stationary scroll, and lastly assembling the retaining plate on the scroll plate of the stationary scroll.

These arrangements also make it possible to decrease the number of component parts of the compressor according to the invention and to ensure precise relative positioning between each bypass valve and the associated retaining means. Such relative positioning is awkward to obtain with the bypass valves of the prior art, since each bypass valve and the associated retaining means are mounted simultaneously using a screw, which results in causing, at the end of screwing, the rotational movement of the retaining member with respect to the corresponding bypass valve.

An intermediate compression chamber refers to a compression chamber having a pressure comprised between the pressure of the first compression chamber "said to be the displacement pressure" and the pressure of the last compression chamber emerging in the delivery conduit.

According to one embodiment of the invention, the compressor comprises a plurality of bypass passages and a plurality of bypass valves each associated with a bypass passage.

Preferably, each recess is further defined by a side wall arranged to guide the refrigerant fluid coming from the corresponding bypass passage in a predetermined direction, for example in the radial or tangential direction so as to limit the turbulence of the refrigerant fluid, and therefore limit the pressure losses. Each side wall may further be arranged to guide the refrigerant fluid coming from the corresponding bypass passage to a predetermined location, for example toward the delivery outlet or any other point. Such guiding of the refrigerant fluid coming from the bypass passage may be used to favor the separation of the oil suspended in the refrigerant fluid or improve the mixing of the different fluids coming from the bypass passages. It should be noted that the recesses may be configured to orient the flows of refrigerant fluid coming from the bypass passages in opposite or identical directions.

According to one embodiment of the invention, the first retaining means include an abutment wall formed on the surface of the retaining plate turned toward the scroll plate of the stationary scroll and in the central portion of the retaining plate, said abutment wall being arranged to limit the amplitude of movement of the delivery valve toward the opening position thereof.

Preferably, each recess is formed in the retaining plate at a location further from the center of the retaining plate than the abutment wall.

According to one embodiment of the invention, the retaining plate is substantially disc-shaped, and each recess is formed in the retaining plate radially outside the abutment wall.

Advantageously, each recess emerges in the outer peripheral edge of the retaining plate.

Advantageously, the compressor comprises at least one bypass valve made in the form of a strip that is elastically deformable between closing and opening positions for closing and opening the corresponding bypass passage. Preferably, each bypass valve is made in the form of a strip that is elastically deformable between the closing and opening positions thereof.

Preferably, each bypass passage comprises at least one bypass conduit formed in the scroll plate of the stationary scroll and comprising a first end emerging in the corresponding intermediate compression chamber and a second end emerging in the surface of the scroll plate of the stationary scroll turned toward the delivery chamber.

According to a first alternative of the invention, each bypass valve is mounted on the surface of the scroll plate of the stationary scroll turned toward the delivery chamber and is arranged to close the second end of the corresponding bypass conduit when it is in the closing position thereof.

According to one embodiment of the invention, the compressor comprises a separating plate assembled on the scroll plate of the stationary scroll, the separating plate at least partially defining the delivery chamber. The separating plate is preferably assembled on the scroll plate of the stationary scroll so as to surround the delivery conduit.

According to this embodiment, each bypass passage further comprises a flow conduit formed in the separating plate and comprising a first end emerging in the surface of the separating plate turned toward the scroll plate of the stationary scroll, and a second end emerging in the delivery chamber, the first end of the flow conduit of each bypass passage being situated substantially across from the second end of the corresponding bypass conduit.

According to a second alternative of the invention, each bypass valve is mounted on the surface of the separating plate turned toward the delivery chamber, and is arranged to close the second end of the corresponding flow conduit when it is in the closing position thereof.

Advantageously, the compressor comprises a sealing member associated with each bypass passage, each sealing member being disposed between the scroll plate of the stationary scroll and the separating plate and arranged to seal the connection between the bypass and flow conduits of the corresponding bypass passage.

Each sealing member is preferably mounted on the surface of the separating plate turned toward the scroll plate of the stationary scroll, and is arranged to cooperate with the scroll plate of the stationary scroll.

According to one embodiment, each sealing member is formed by an annular sealing gasket. Each annular sealing gasket is advantageously mounted in an annular slot formed in the surface of the separating plate turned toward the scroll plate of the stationary scroll so as to surround the first end of the corresponding flow conduit.

Preferably, the valve arrangement includes a valve plate comprising at least one delivery opening, a valve seat on which the delivery valve is designed to bear being formed on the surface of the valve plate turned toward the delivery chamber.

According to one embodiment of the invention, the scroll plate of the stationary scroll has an outer peripheral wall sealably fastened on the inner wall of the sealed casing.

According to one advantageous feature of the invention, the compressor comprises sealing means disposed between the separating plate and the scroll plate of the stationary scroll.

According to one embodiment of the invention, each bypass valve is fastened using a fastening screw also used to fasten the retaining plate and/or the valve plate.

According to another embodiment of the invention, each bypass valve is assembled by pinching between the retaining plate and the surface forming the seat of said bypass valve.

BRIEF DESCRIPTION OF THE DRAWINGS

In any case, the invention will be well understood using the following description done in reference to the appended diagrammatic drawing showing, as non-limiting examples, several embodiments of this scroll refrigeration compressor.

DETAILED DESCRIPTION

In the following description, the same elements are designated using the same references in the various embodiments.

Figure 1:
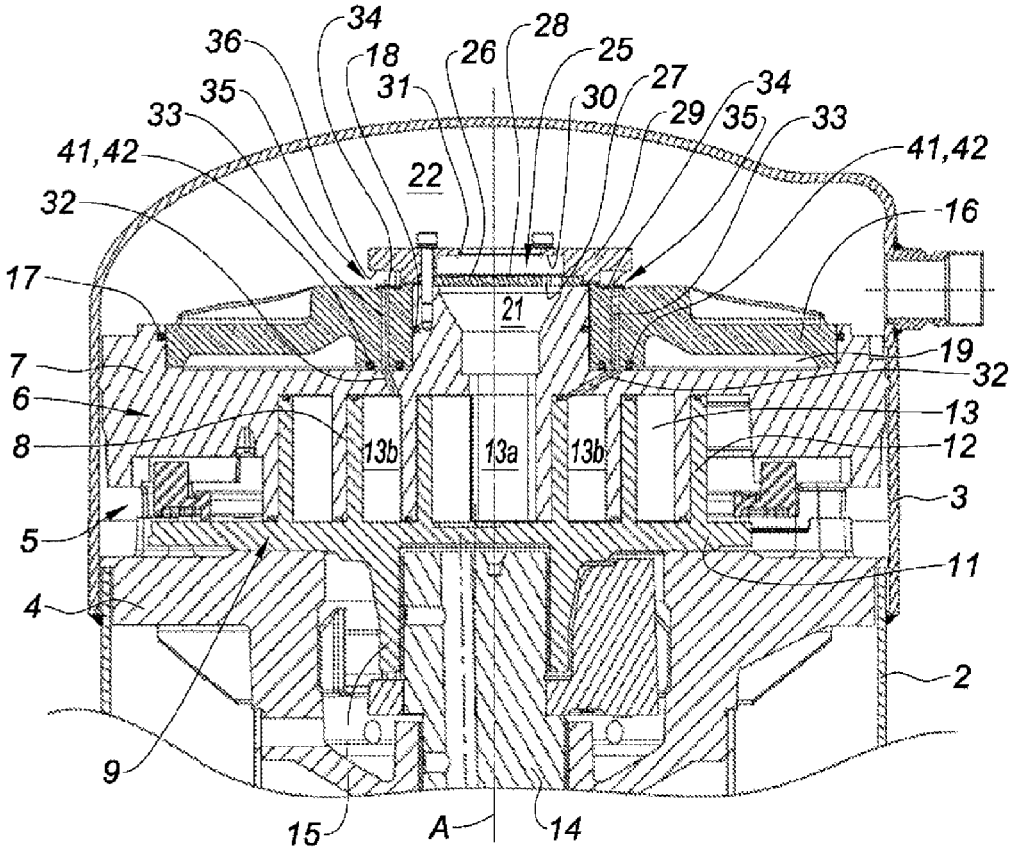
FIG. 1 is a partial longitudinal cross-sectional view of the scroll refrigeration compressor according to a first embodiment of the invention.
Figure 2:
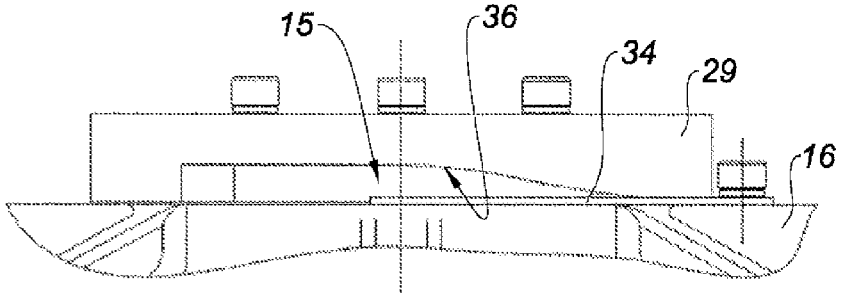
FIG. 2 is a partial side view of the stationary scroll of the compressor of FIG. 1 showing a bypass valve in the closing position.

FIG. 1 describes a scroll refrigeration compressor in a vertical position. However, the compressor according to the invention may be in an inclined position or horizontal position, without the structure being significantly modified.

The compressor shown in FIG. 1 comprises a sealed casing delimited by a shell 2 whereof the upper and lower ends are respectively closed by a cover 3 and a base (not shown in FIG. 1). The assembly of this casing may in particular be done using weld seams.

The intermediate part of the compressor is occupied by a body 4 that is used to mount a refrigerant gas compression stage 5. This compression stage 5 comprises a stationary scroll 6 including a scroll plate 7 from which a stationary spiral wrap 8 extends turned downward, and a moving scroll 9 including a scroll plate 11 bearing against the body 4 and from which a spiral wrap 12 extends turned upward. The two spiral wraps 8 and 12 of the two scrolls penetrate one another to form variable-volume compression chambers 13.

The compressor comprises an electric motor (not shown in the figures) including a rotor secured to a drive shaft 14 whereof the upper end is off-centered like a crankshaft. This upper part is engaged in a sleeve-forming part 15, included by the moving scroll 9. During rotation thereof by the motor, the drive shaft 14 drives the moving scroll 9 in an orbital movement.

The compressor comprises a separating plate 16 sealably mounted on the scroll plate 7 of the stationary scroll 6. The separating plate 16 is mounted on the scroll plate 7 of the stationary scroll 6 so as to allow a relative movement between the separating plate and the stationary scroll 6 along the longitudinal axis A of the compressor. In order to ensure sealing between the separating plate 16 and the stationary scroll 6, the compressor comprises a first annular seal 17 mounted on the scroll plate of the stationary scroll and arranged to cooperate with the outer edge of the separating plate, and a second annular seal 18 mounted on the scroll plate of the stationary scroll and arranged to cooperate with the inner edge of the separating plate.

The separating plate 16 and the scroll plate 7 of the stationary scroll 6 define an annular intermediate volume 19.

The compressor further comprises a delivery conduit 21 formed in the central part of the stationary scroll 6. The delivery conduit 21 comprises a first end emerging in the central compression chamber 13*a* and a second end designed to be communicated with a high-pressure delivery chamber 22 defined by the casing of the compressor, the scroll plate of the stationary scroll 6 and the separating plate 16. The separating plate 16 is mounted on the scroll plate 7 of the stationary scroll so as to surround the delivery conduit 21.

The compressor comprises a valve arrangement 25. The valve arrangement 25 includes a valve plate 26 in the form of a disc mounted on the scroll plate 7 of the stationary scroll 6 at the second end of the delivery conduit 21. The valve plate 26 comprises a plurality of delivery openings 27 arranged to communicate the delivery conduit 21 and the delivery chamber 22.

The valve arrangement 25 also includes a delivery valve 28 movable between a closing position, in which the delivery valve 28 closes the delivery openings 27, and an opening position, in which the delivery valve 28 opens the delivery openings 27. The delivery valve 28 is designed to be moved into its opening position when the pressure in the delivery conduit 21 exceeds the pressure in the delivery chamber 22 by a predetermined value substantially corresponding to the adjustment pressure of the delivery valve 28. The delivery valve 28 for example is substantially disc-shaped.

The compressor also comprises a retaining plate 29 mounted on the valve plate 26 and designed to serve as an abutment for the delivery valve 28 when it is in its opening position. The retaining plate 29 comprises at least one passage opening 31 arranged to allow a flow of refrigerant fluid from the delivery openings 27 toward the delivery chamber 22. The retaining plate 29 is arranged to limit the travel of the separating plate 16 with respect to the scroll plate 7 of the stationary scroll. In fact, the lower face of the retaining plate 29 forms an abutment arranged to cooperate with the upper face of the separating plate 16.

The retaining plate 29 further comprises an abutment wall 30 formed in the central portion of the retaining plate and on the surface thereof turned toward the scroll plate 7 of the stationary scroll 6. The abutment wall is preferably substantially annular, and is arranged to limit the movement amplitude of the delivery valve 28 toward the opening position thereof.

The compressor further comprises two bypass passages that are angularly offset with respect to the longitudinal axis A of the compressor and each arranged to communicate the delivery chamber 22 with a distinct intermediate compression chamber 13*b*.

Each bypass passage is formed by a bypass conduit 32 formed in the scroll plate of the stationary scroll and comprising a first end emerging in the corresponding intermediate compression chamber 13*b* and a second end emerging in the surface of the scroll plate of the stationary scroll turned toward the delivery chamber 22, and on the other hand by a flow conduit 33 formed in the separating plate and comprising a first end emerging in the surface of the separating plate turned toward the scroll plate of the stationary scroll, and a second end emerging in the delivery chamber 22. The first end of the flow conduit 33 of each bypass passage is situated substantially across from the second end of the corresponding bypass conduit 32.

The compressor further comprises two bypass valves 34. Each bypass valve 34 is movable between a closing position for closing one of the bypass passages, and an opening position for opening said bypass passage. Each bypass valve 34 is designed to be moved into the opening position thereof when the pressure in the intermediate compression chamber in which the corresponding bypass passage emerges exceeds the pressure in the delivery chamber 22 by a predetermined value substantially corresponding to the adjustment pressure of said bypass valve 34.

Each bypass valve 34 is assembled on the surface of the separating plate 16 turned toward the delivery chamber 22, and is arranged to close the second end of the corresponding flow conduit when it is in its closing position.

Furthermore, each bypass valve 34 is advantageously made in the form of a strip that is elastically deformable between a closing position for closing the corresponding flow conduit and an opening position for opening said flow conduit.

The compressor also comprises two recesses 35 formed on the surface of the retaining plate 29 turned toward the scroll plate 7 of the stationary scroll 6. Each recess 35 is partially defined by a bottom wall 36 forming an abutment surface arranged to limit the movement amplitude of the associated bypass valve 34 toward the opening position thereof. Each recess 35 is furthermore defined by a side wall 37 arranged to guide the refrigerant fluid coming from the corresponding bypass passage in a predetermined direction.

Figure 3:
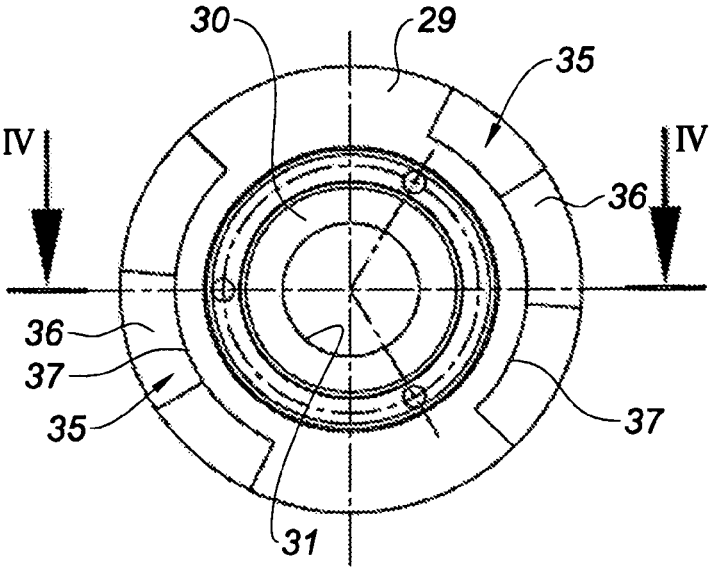
FIG. 3 is a bottom view of the retaining plate of the compressor of FIG. 1.
Figure 4:
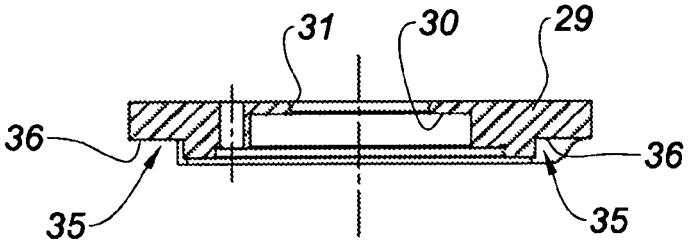
FIG. 4 is a cross-sectional view of the retaining plate along line IV-IV of FIG. 3.
Figure 5:
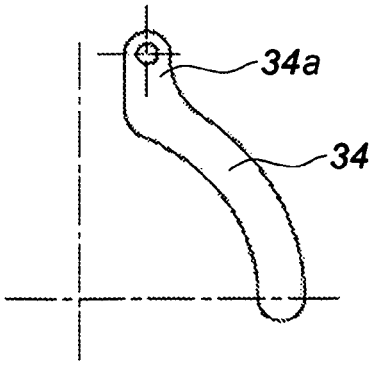
FIG. 5 is a top view of the bypass valve of the compressor of FIG. 1.

As shown in FIG. 3, the retaining plate 29 is substantially disc-shaped, and each recess 35 is formed in the retaining plate 29 radially outside the abutment wall 30 and emerges in the outer peripheral edge of the retaining plate 29. Each recess 35 extends substantially in an arc of circle, while each bypass valve 34 has, as shown in FIG. 5, a fastening portion 34*a* that is substantially rectilinear, and a closing portion in the form of an arc of circle.

The compressor comprises an annular sealing gasket 41 associated with each bypass valve. Each annular sealing gasket 41 is mounted in an annular slot 42 with a complementary shape formed in the surface of the separating plate turned toward the scroll plate of the stationary scroll so as to surround the first end of the corresponding flow conduit. Each annular sealing gasket 41 is arranged to seal the connection between the bypass and flow conduits 32, 33 of the corresponding bypass passage.

The operation of the scroll compressor will now be described.

When the scroll compressor according to the invention is started, the moving scroll 9 is driven by the drive shaft 14 in an orbital movement, this movement of the moving scroll causing an intake and compression of refrigerant fluid in the variable-volume compression chambers 13.

Under optimal operating conditions, each bypass valve 34 is subject, on the face thereof turned toward the separating plate, to a pressure lower than the pressure in the delivery chamber 22. Thus, said bypass valves 34 are kept in their closing position and consequently isolate the corresponding bypass passage of the delivery chamber 22.

As a result, all of the refrigerant fluid compressed in the compression chambers 13 reaches the center of the spiral wraps and escapes through the delivery conduit 21 toward the delivery chamber 22 by moving the delivery valve 28 into the opening position thereof, and lastly by flowing axially through the delivery openings 27 and the passage openings 31.

Under non-optimal operating conditions, for example seasonally, during startup, or during deicing of the compressor, each bypass valve 34 may be subject, on the face thereof turned toward the separating plate 16, to a pressure higher than the pressure in the delivery chamber 22. In that scenario, the bypass valves 34 deform elastically toward the opening position thereof and communicate the intermediate compression chambers 13*b* in which the corresponding bypass passages 32 emerge with the delivery chamber 22.

This thereby results in a delivery to the delivery chamber 22 of part of the refrigerant fluid compressed in the intermediate compression chambers 13*b* in which the bypass passages 32 emerge before that part of the refrigerant fluid reaches the center of the spiral wraps.

Figure 6:
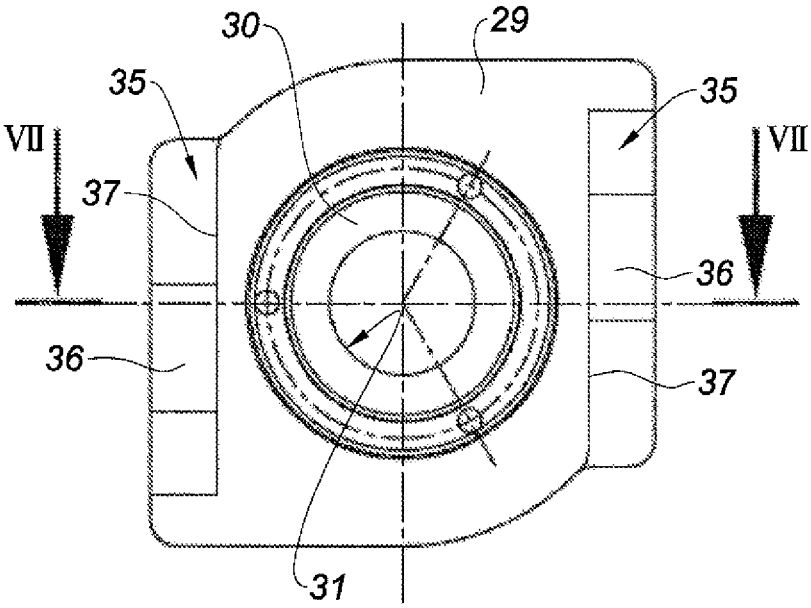
FIG. 6 is a top view of the retaining plate according to one alternative embodiment of the invention.
Figure 7:
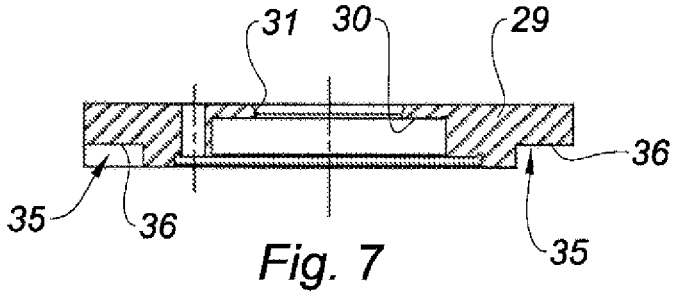
FIG. 7 is a cross-sectional view of the retaining plate along line VII-VII of FIG. 6.

FIGS. 6 and 7 shows an alternative embodiment of the retaining plate 26 according to which each recess 35 is substantially rectilinear.

Figure 8:
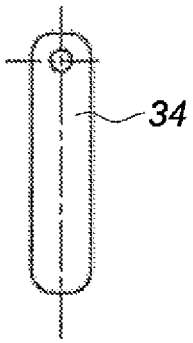
FIG. 8 is a top view of a bypass valve according to one alternative embodiment of the invention.

FIG. 8 shows an alternative embodiment of each bypass valve 34 according to which each bypass valve 34 is substantially rectilinear.

Figure 9:
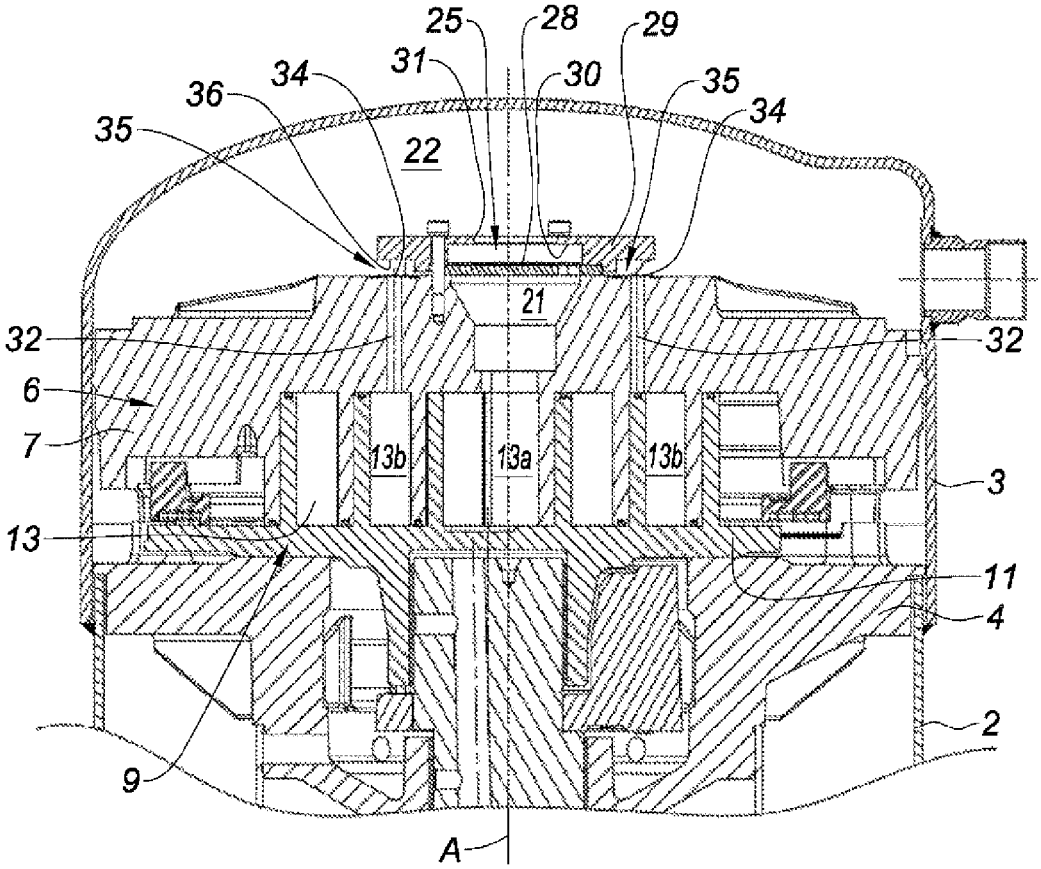
FIG. 9 is a partial longitudinal cross-sectional view of the scroll refrigeration compressor according to a second embodiment of the invention.

FIG. 9 shows a scroll refrigeration compressor according to a second embodiment of the invention that differs from that shown in FIG. 1 essentially in that it does not include a separating plate and in that each bypass valve 34 is mounted on the surface of the scroll plate 7 of the stationary scroll 6 turned toward the delivery chamber 22 and is arranged to cover the second end of the corresponding bypass conduit when it is in the closing position thereof.

The invention is of course not limited solely to the embodiments of this scroll refrigeration compressor described above as examples, but on the contrary encompasses all alternative embodiments.

The invention claimed is:

1. A scroll refrigeration compressor comprising:

a sealed casing containing a stationary scroll and a moving scroll following an orbital movement, each scroll including a scroll plate from which a spiral wrap extends, the spiral wraps of the stationary and moving scrolls being engaged in one another and defining variable-volume compression chambers, a delivery conduit, formed in a central portion of the scroll plate of the stationary scroll, comprising a first end emerging in a central compression chamber and a second end configured to be communicated with a delivery chamber at least partially defined by the sealed casing, a valve arrangement mounted on the scroll plate of stationary scroll at the second end of the delivery conduit, the valve arrangement comprising:

at least one delivery opening arranged to communicate the delivery conduit and the delivery chamber, a delivery valve movable between closing and opening positions for closing and opening the at least one delivery opening, the delivery valve being configured to be moved into the opening position when the pressure in the delivery conduit exceeds the pressure in the delivery chamber by a predetermined value, first retaining element configured to limit the amplitude of movement of the delivery valve toward the opening position, at least one bypass passage arranged to communicate the delivery chamber with an intermediate compression chamber, at least one bypass valve associated with a bypass passage, each bypass valve associated with a bypass passage being movable between closing and opening positions for closing and opening the corresponding bypass passage, and being configured to be moved into the opening position when the pressure in the intermediate compression chamber in which the corresponding bypass passage emerges exceeds the pressure in the delivery chamber by predetermined value, second retaining element configured to limit the amplitude of movement of each bypass valve toward the opening position, wherein the compressor includes a retaining plate mounted on the scroll plate of the stationary scroll and on which the first and second retaining elements are formed, and the second retaining element includes at least one recess formed on a surface of the retaining plate turned toward the scroll plate of the stationary scroll, each recess being at least partially defined by a bottom wall forming an abutment surface arranged to limit the amplitude of movement of the associated bypass valve toward the opening position.

2. The compressor according to claim 1, wherein the first retaining element includes an abutment wall formed on the surface of the retaining plate turned toward the scroll plate of the stationary scroll and in a central portion of the retaining plate, said abutment wall being arranged to limit the amplitude of movement of the delivery valve toward the opening position.

3. The compressor according to claim 2, wherein each recess is formed in the retaining plate at a location further from the center of the retaining plate than the abutment wall.

4. The compressor according to claim 1, wherein the compressor comprises at least one bypass valve made in the form of a strip that is elastically deformable between closing and opening positions for closing and opening the corresponding bypass passage.

5. The compressor according to claim 1, wherein each bypass passage comprises at least one bypass conduit formed in the scroll plate of the stationary scroll and comprising a first end emerging in intermediate compression chamber and a second end emerging in a surface of the scroll plate of the stationary scroll turned toward the delivery chamber.

6. The compressor according to claim 5, wherein each bypass valve is mounted on the surface of the scroll plate of the stationary scroll turned toward the delivery chamber and is arranged to close the second end of the corresponding bypass conduit when said bypass valve is in the closing position.

7. The compressor according to claim 1, wherein the compressor comprises a separating plate assembled on the scroll plate of the stationary scroll, the separating plate at least partially defining the delivery chamber.

8. The compressor according to claim 7, wherein each bypass passage comprises:

at least one bypass conduit formed in the scroll plate of the stationary scroll and comprising a first end emerging in the corresponding immediate compression chamber and a second end emerging in a surface of the scroll plate of the stationary scroll turned toward the delivery chamber; and a flow conduit formed in the separating plate and comprising a first end emerging in the surface of the separating plate turned toward the scroll plate of the stationary scroll, and a second end emerging in the delivery chamber, the first end of the flow conduit of each bypass passage being situated substantially across from the second end of the corresponding bypass conduit.

9. The compressor according to claim 8, wherein each bypass valve is assembled on the surface of the separating plate turned toward the delivery chamber, and is arranged to close the second end of the corresponding flow conduit when said bypass valve is in the closing position.

10. The compressor according to claim 8, wherein the compressor comprises a sealing member associated with each bypass passage, each sealing member being disposed between the scroll plate of the stationary scroll and the separating plate and arranged to seal the connection between the bypass and flow conduits of the corresponding bypass passage.

11. The compressor according to claim 1, wherein the valve arrangement includes a valve plate comprising at least one delivery opening, a valve seat on which the delivery valve is configured to bear being formed on the surface of the valve plate turned toward the delivery chamber.

12. The compressor according to claim 1, wherein the retaining plate has an outer peripheral edge in which each recess emerges.

* * * * *